United States Patent [19]

Kappenhagen

[11] 4,149,615

[45] Apr. 17, 1979

[54] APPARATUS FOR MOUNTING AN ELEVATOR DOOR OPERATOR

[75] Inventor: George A. Kappenhagen, Monroe Township, Monroe County, Pa.

[73] Assignee: Westinghouse Electric Corp., Pittsburgh, Pa.

[21] Appl. No.: 833,626

[22] Filed: Sep. 15, 1977

[51] Int. Cl.[2] ..... B66B 13/08

[52] U.S. Cl. ..... 187/52 R; 49/360; 49/409; 187/56

[58] Field of Search ..... 187/51, 52 R, 54, 56; 49/138, 360, 409

[56] References Cited

U.S. PATENT DOCUMENTS

| | | | |
|---|---|---|---|
| 3,425,162 | 2/1969 | Halpern | 49/409 |
| 4,004,655 | 1/1977 | Kraft et al. | 187/52 R |

*Primary Examiner*—Bruce H. Stoner, Jr.
*Assistant Examiner*—Jeffrey V. Nase
*Attorney, Agent, or Firm*—D. R. Lackey

[57] ABSTRACT

An elevator system including an elevator car having an entranceway, a door having one or more door panels mounted for movement to open and close the entranceway, a door operator for the door, and mounting hardware for mounting the door operator on top of the elevator car. The mounting hardware provides horizontal and vertical adjustment of the door operator, with all adjustments being easily made from the top of the car. When the elevator car has a two-speed door, the high and low speed hanger tracks are horizontally spaced from one another, and they are mounted outside of the vertical projection of the door operator frame. The door hanger plates for both the high and low speed door panels are disposed between the hanger roller tracks. The spacing between the high and low speed roller tracks enables the hanger plates and door panels to be placed in position, or to be removed, from the top of the car.

14 Claims, 3 Drawing Figures

40
152
160
174
164
132
130
42
116
28
30
12
113
138
144
126
76
170
162
166
70
72
80
112
120
150
136
142
158
156
172
159
154
124
111
106
46
74
55
110
34
58
50
48
54
59
36
44
10
104
102

APPARATUS FOR MOUNTING AN ELEVATOR DOOR OPERATOR

BACKGROUND OF THE INVENTION

1. Field of the Invention

The invention relates in general to elevator systems, and more specifically to the door operator for imparting rectilinear motion to the door panels of an elevator car.

2. Description of the Prior Art

U.S. Pat. No. 4,004,655, which is assigned to the same assignee as the present application, discloses a new and improved door operator for the door of an elevator car, in which the drive motor, controls, switches, belts, pulleys, and the like, are all mounted within a common enclosure. The common enclosure functions as a junction box, permitting open wiring between the electrical components.

Elevator cabs are manufactured to have a plurality of different sizes, depending upon the desired capacity. Elevator cabs also have different basic constructions, such as wood, or metal panels. The car may have a single door, or it may have front and rear doors. The door may be side opening, right or left, or center opening. The door may have a single door panel, a pair of door panels, a single pair of two-speed door panels, or two pairs of two-speed door panels.

It would be desirable to provide universal mounting hardware for the door operator, making it unnecessary to provide different mounting brackets for each different car size/door arrangement, combination. It would also be desirable to provide universal mounting hardware which may be easily installed and adjusted by personnel from the top of the elevator car.

SUMMARY OF THE INVENTION

Briefly, the present invention is a new and improved elevator system including an elevator car having an entrance-way, a door mounted for rectilinear motion to open and close the entranceway, and a door operator on the top of the elevator car. The door operator is shock-mounted on top of the elevator car with universal mounting brackets and resilient coupling members which provide quick, accurate adjustment of the door operator horizontally in two directions, i.e., side-to-side, and front-to-back, and vertically. All adjustment points are accessible from a position on the top of the elevator car.

When a two-speed door is required, the high and low speed hanger roller tracks are mounted outside the vertical projection of the door operator frame, and relatively high compared with the normal prior art position of the hanger roller tracks. Further, the high and low speed hanger roller tracks are horizontally spaced apart, and the door hanger plates for both the high and low speed door panels are disposed between the tracks. This construction enables the hanger plates, or the hanger plates with the door panels attached, to be installed, or removed, by personnel located on the top of the elevator car.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
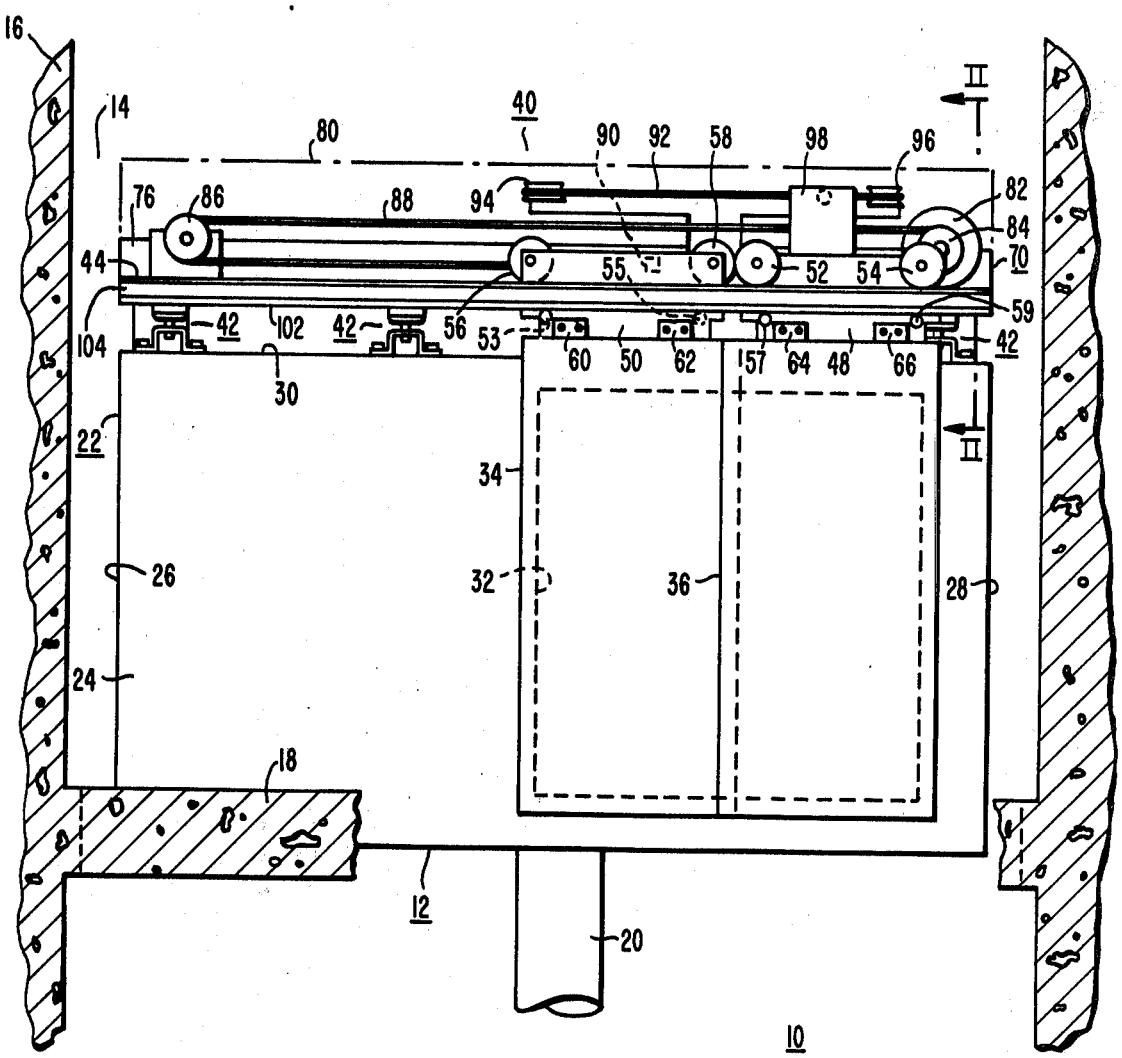
FIG. 1 is a front elevational view of an elevator system constructed according to the teachings of the invention.
Figure 2:
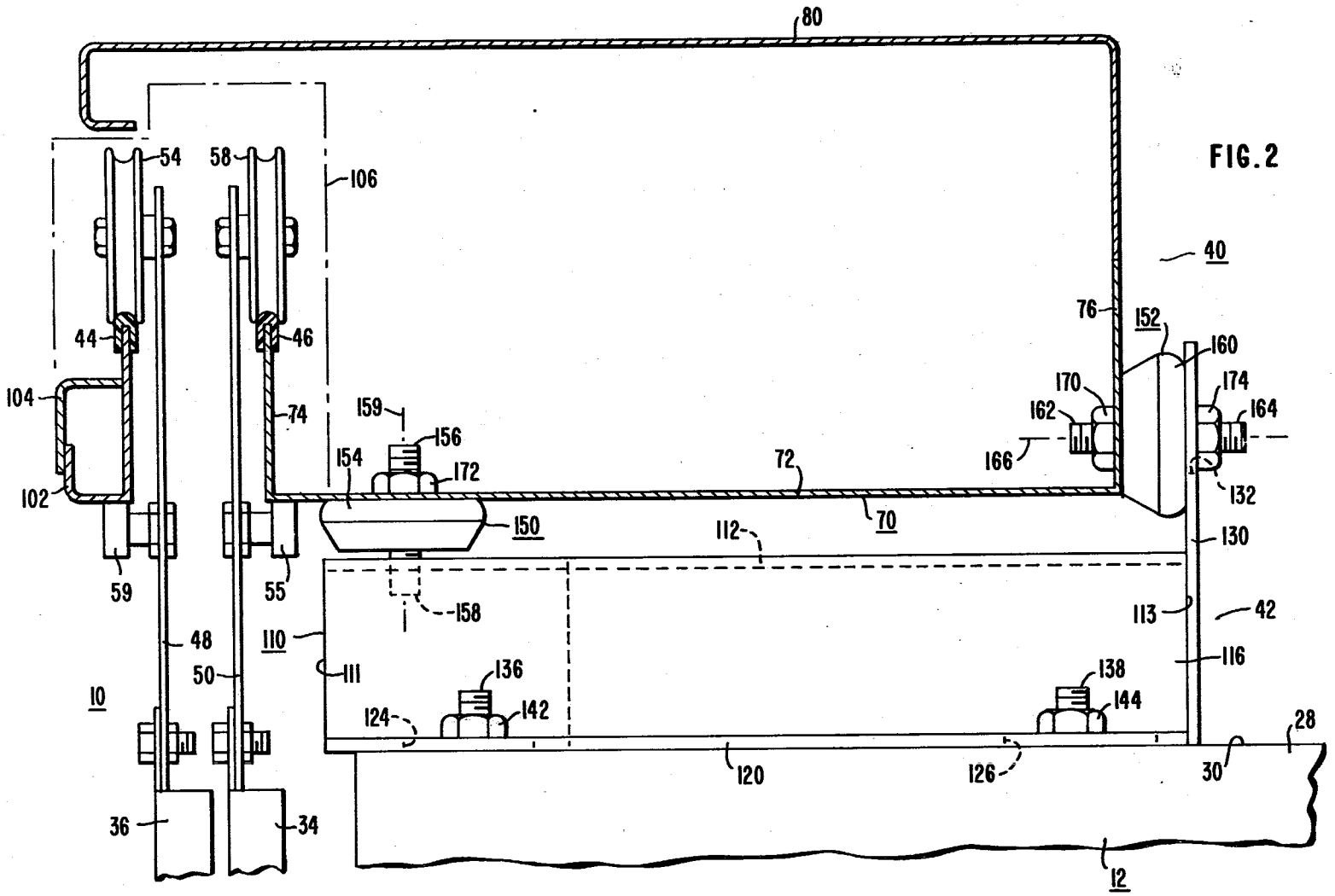
FIG. 2 is an enlarged fragmentary view, in side elevation, of a portion of the elevator system shown in FIG. 1 taken between and in the direction of arrows II—II.
Figure 3:
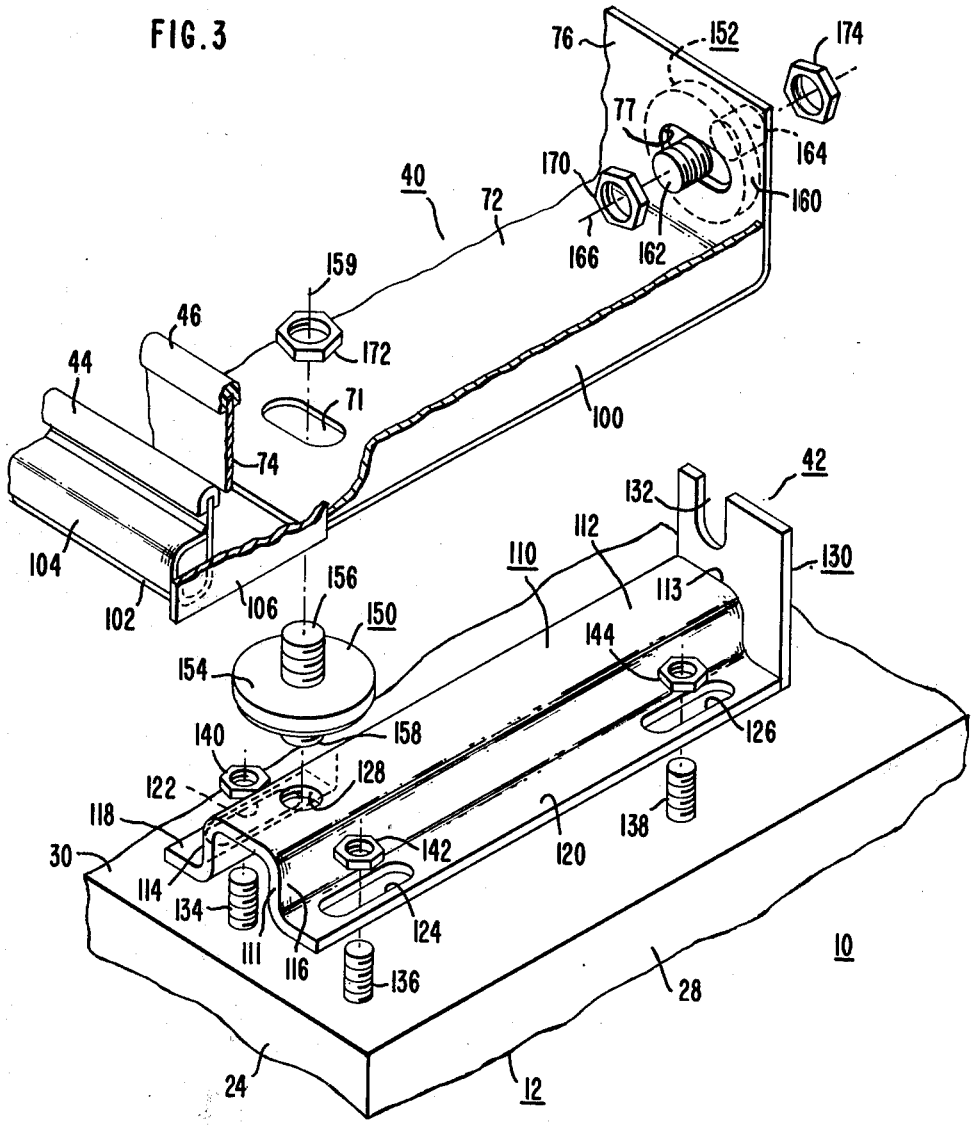
FIG. 3 is an exploded perspective view of a portion of the elevator system shown in FIG. 1.

Referring now to the drawings, FIG. 1 is an elevational view of an elevator system 10 constructed according to the teachings of the invention. FIGS. 2 and 3 will also be referred to in describing the invention, with FIG. 2 being a fragmentary view of elevator system 10 in side elevation, taken between and in the direction of arrows II—II of FIG. 1. FIG. 3 is an exploded perspective view of a selected portion of the elevator system 10 shown in FIG. 1.

More specifically, elevator system 10 includes an elevator car 12 mounted for vertical movement in the hoistway 14 of a structure 16 to serve the floors therein, with the floors being illustrated generally with reference 18. While the elevator system 10 may be of the traction type, the invention is particularly well suited to elevators of the hydraulic type, and, for purposes of example it will be assumed that the elevator system 10 is a hydraulic elevator which includes a jack 20 fastened to the bolster plate at the bottom of the elevator car 12.

The elevator car 12 includes a cab or enclosure 22 the outside of which may be constructed of wood or sheet steel panel members which define a bottom, four sides and a top, such as front 24, sides 26 and 28, and a top 30. Front 24 includes a passenger opening 32 and car door having door panels 34 and 36. The back may also have a passenger opening. Since the rear door and its door operator would be similar to the front door and its door operator, for purposes of example the invention will be described relative to an elevator car having only a front door. The invention applies to an elevator car door having one or more door panels. Certain aspects of the invention are particularly applicable to elevator cars having a two-speed door, which may be side opening, in which there will be two door panels, or center opening, in which there will be four door panels. Two door panels for a side opening door are illustrated, for purposes of example. The car door panels 34 and 36 when operated, include conventional vane and drive block apparatus (not shown) for engaging the hoistway door panels at each floor, to operate the hoistway door panels in unison with the car door panels.

Elevator system 10 includes a door operator 40. For purposes of example, the door operator disclosed in the hereinbefore mentioned U.S. patent will be modified according to the teachings of the invention, and this patent may be referred to for details which are not important to the present invention, and which are therefore are omitted from the drawings.

Door operator 40 is mounted on the top 30 of the elevator car 12 via a plurality of universal brackets and mounting hardware, shown generally at 42, which will be hereinafter described in detail.

Door operator 40 includes first and second hanger roller tracks 44 and 46, which will also be hereinafter described in detail. Hanger plates 48 and 50 are mounted on hanger roller tracks 44 and 46, respectively, via hanger rollers 52 and 54 journaled for rotation on hanger plate 48, and hanger rollers 56 and 58 journaled for rotation on hanger plate 50. Hanger plate 48 additionally includes conventional upthrust rollers 57 and 59, and hanger plate 50 additionally includes upthrust rollers 53 and 55. Door panel 34 includes hanger brackets 60 and 62 at its upper end, which are fastened to hanger plate 50 via suitable hardware. Door panel 36 includes hanger brackets 64 and 66 at its upper end, which are fastened to hanger plate 48 via suitable hardware. Door operator 40 includes a metallic, channel-shaped base frame member 70 having a bight portion 72 and first and second upstanding leg portions 74 and 76, respectively. The bight 72 includes a plurality of elongated openings or slots 71, at least one for each of the universal mounting brackets, and the second upstanding leg portion 76 includes a plurality of elongated openings or slots 77. Slots 77 also cooperate with the universal brackets 42 in mounting the door operator 40 on the top of the elevator car. The long dimension of slots 71 and 77 is parallel with the tracks 44 and 46, i.e., slots 71 and 77 provide adjustment across the front of the elevator car in the direction of the hanger roller tracks.

The base frame member 70 is mounted on the top 30 of the elevator car 12 via the universal brackets 42, with the length of the base frame member 70 in the direction of its channel extending substantially across the entire width of the side of the elevator car which includes passenger entrance 32. The base frame member 70 is mounted with its first leg portion 74 overhanging the passenger entrance side of the elevator car by a predetermined dimension, as best shown in the end view of the door operator 40 in FIG. 2.

Base frame member 70 provides a support base for all of the components of the door operator 40. It also cooperates with a cover 80 to provide an enclosure for these components. Cover 80 is shown in phantom in FIG. 1, and in cross section in FIG. 2.

As hereinbefore stated, the components of door operator 40 are all mounted on the base frame member 70. These components include an electrical drive motor 82, pulleys 84 and 86, and a belt 88 which drives door 34 via a door puller shown generally at 90.

A high speed belt 92 mounted on pulleys 94 and 96 is driven via suitable relating equipment at a higher speed than belt 88, and a high speed door puller 98 is connected from belt 92 to door hanger plate 48 to drive the high speed door 36. Of course, other two-speed door driving arrangements may be used.

End members or portions, such as end portion 100 shown in FIG. 3, are provided which extend across the bight 72 perpendicular to the inner surfaces of the first and second leg portions 74 and 76. The end portions extend upwardly beyond the height of the first and second leg portions to provide a support for the cover 80.

The door hanger track 46 may be formed by placing a suitable member over the upstanding edge of the first leg member 74. A Nylon extrusion, or a member formed of any suitable low friction material may be used.

When a two-speed door is required, the track 44 for the high speed door panel 36 is constructed by welding a J-shaped member 102 and an L-shaped member 104 together, as illustrated in FIGS. 2 and 3, to form a tubular structure having an upstanding leg portion. A member 44, similar in construction to that described relative to track 46, is disposed on the upper edge of this leg portion. Unlike the usual prior art hanger roller track construction for a two-speed door, the fast track 44 is horizontally spaced from the slow track 46, with the spacing being selected to enable the hanger plates 48 and 50 to extend upwardly between the spaced tracks. The high speed track 44 is connected to the base frame 70 via suitable end plates, such as end plate 106, which plates are welded across the ends of the tracks. This construction keeps the hanger roller tracks open, both from below and from above, enabling the hanger plates, with or without the door panels attached, to be placed in position and removed from either the top of fhe car or from below. This is very important, as the most suitable clearance for removing the door panels during maintenance may be from above, rather than from below. It will be noted that the hanger roller tracks 44 and 46 are in the same horizontal plane, and that they are not only disposed outside of the vertical projection of the door operator base frame 70, but they are high relative to the car 12 and to the door operator 40. The relatively high placement of the hanger roller tracks further facilitates removal of the hanger plates and door panels by maintenance personnel located on the top of the elevator car 12. The upthrust rollers, which normally ride on the lower surface of bight 72 and the lower surface of J-shaped member 102 may be loosened, if necessary, to permit the associated hanger plates and door panels to be angled sufficiently to clear the upthrust rollers as the door panels are lifted out of position from above.

The door operator 40 is shock-mounted on the top 30 of elevator car 12 via a plurality of universal mounting assemblies 42. The assemblies 42 at each end of the door operator 40 may be similar, except for right and left-hand construction. Intermediate assemblies may be similar to the end assemblies, or they may be modified to eliminate a rear support function, which is usually not required for an intermediate support. They all, however, are of a universal construction applicable equally to wood or steel cabs, while enabling horizontal and vertical adjustment of the door operator by personnel located on the top of the car.

Each universal assembly 42 includes a metallic channel-shaped member 110 having first and second ends 111 and 113, respectively, a bight 112, first and second spaced, parallel leg portions 114 and 116, and integral flanges 118 and 120 which extend perpendicularly outward from the legs 114 and 116, respectively. The flat major opposed lower surfaces of the flanges 118 and 120 are in a common plane. The leg 114 and flange 118 which face the center of the door operator may be terminated before reaching end 113, as illustrated most clearly in FIG. 3.

An elongated opening or slot 122 is provided in flange 118 near end 111 of the channel-shaped member 110, with the longitudinal dimension being in a direction parallel with the long dimension of the channel-shaped member 110. A similar slot 124 is provided in flange 120 near end 111, and at least one additional slot 126 is provided in flange 120 near end 113. At least one tapped opening 128 is provided in bight 112, near end 111.

A plate member 130 having an elongated open ended slot 132, is welded to end 113 of channel member 110, such that the open end of slot 132 is located at the top of the upstanding plate member. The long dimension of slot 132 is vertically oriented.

The resulting assembly of the channel-shaped member 110 and the upstanding plate member 130 is adjustably fastened to the top 30 of the elevator car 12 via through bolts 134, 136 and 138 which extend through openings in the top of the cab which are aligned with slots 122, 124 and 126, respectively. The through bolts extend through the slots and the channel member 110 is secured in position by nuts 140, 142 and 144. The slots 122, 124 and 126 allow adjustment of the brackets in a horizontal plane in a direction which is perpendicular to the front 24 of the elevator car. Thus, when the door operator 40 is mounted on the universal mounting brackets, precise positioning of the door operator in a direction perpendicular to the front 24 may easily be achieved by loosening the nuts of each bracket assembly, locating the door operator in the desired horizontal position in the front-to-back direction, and then tightening the nuts.

The door operator 40 is fastened to each of the plurality of universal mounting bracket assemblies 42 via at least first and second resilient coupling members 150 and 152 which shock-mount the door operator 40 and isolate it from the cab. Coupling member 150 includes an elastomeric body portion 154 and first and second co-axial threaded stud portions 156 and 158 which extend outwardly in opposite directions from body portion 154 on center line 159. Coupling member 152 is of like construction, having an elastomeric body portion 160 and first and second co-axial threaded stud portions 162 and 164 which extend outwardly in opposite directions from the body portion 160 on center line 166.

Stud 158 of coupling member 150 is threadably engaged with the tapped opening 128 in the bight 112 of the channel-shaped member 110. Depending on the weight of the door operator, an additional tapped opening may be provided in bight 112, and an additional coupling member used. In this instance, an additional slot would be necessary in the bight 72 of the base frame member 110.

Stud 162 of coupling member 152 is inserted through slot 77 in the second upstanding leg portion 76 and snugged in this position, but not tightened, by threadably engaging a nut 170 with stud 162.

The door operator 40 is now ready to be placed in position on the universal mounting brackets 42. The studs 156 of coupling members 150 extend upwardly through slots 71, and studs 164 of coupling members 152 drop vertically into the slots 132 in the upstanding plate member 130. The desired height of the hanger roller tracks 44 and 46 is selected by turning the coupling members 150 by hand in the proper direction, and nuts 172 are threadably engaged with studs 156. Leveling of the tracks is also achieved by turning coupling members 150, to achieve horizontal leveling. Nuts 172 are not tightened at this point. After the desired vertical height and front leveling is achieved, the door operator 40 is leveled front-to-back, by sliding studs 164 in slots 132 upwardly, or downwardly, as required, and then threadably engaging nuts 174 with studs 164.

Precise front-to-back positioning of the door operator, as hereinbefore described, is achieved by loosening the nuts 140, 142 and 144 of each universal mounting bracket assembly 42 and sliding the door operator and brackets until the desired front-to-back positioning is achieved. Nuts 140, 142 and 144 may then be tightened on each of the universal mounting brackets.

Horizontal positioning in a direction perpendicular to the horizontal adjustment provided by slots 122, 124 and 126 in the mounting brackets, is achieved by loosening nuts 170 and 172 to the point where the door operator 40 may be moved in slots 77 and 71. The door operator 40 is moved in the proper direction to achieve the desired side-to-side positioning, and nuts 170 and 172 are then tightened.

The intermediate universal mounting brackets 42 may be substantially the same as the mounting brackets 42 disposed at the two ends of the door operator. However, since most of the weight is concentrated at the front of the door operator, the intermediate brackets 42 may be modified by eliminating the rear support function. Thus, the length of the intermediate brackets may be substantially reduced as they will be required to accept only a single resilient coupling member.

In summary, there is then disclosed a new and improved elevator system which includes universal mounting brackets for the door operator which are suitable for mounting the door operator on wood or steel cabs. Resilient coupling members are utilized to mount the door operator on the universal mounting brackets, and in addition to shock-mounting the door operator, the shock mounts may be turned by hand from a position on top of the elevator car to achieve the desired height of the hanger roller tracks, as well as leveling of the hanger roller tracks. Shock mounts at the rear of the door operator cooperate with vertical slots defined by the rear wall of the door operator casing. Front-to-back leveling of the door operator is achieved by moving the door operator up and down in these slots. Slots formed in the universal mounting brackets are also accessible from a position on top of the elevator car, and they enable the door operator to be positioned in a horizontal direction perpendicular to the hanger roller tracks, simply by sliding the door operator and the universal mounting brackets in these slots.

When the elevator system utilizes a two-speed door, the fast track is mounted outside the door hangers. In other words, the high and low speed hanger roller tracks are horizontally spaced outside of the vertical projection of the door operator frame, with the spacing between the tracks being sufficient for both of the high and low speed hanger plates to extend upwardly between the tracks. This spacing is also sufficient to enable someone located on the top of the elevator car to remove the hanger plates by lifting them vertically upward off the hanger roller tracks. The hanger roller plates with door panels attached may both be removed vertically from a position on top of the elevator car, if desired. This construction enables the hanger plates for a two-speed door and relating equipment to be factory-installed and adjusted, and they may be shipped as part of the door operator, instead of part of the door panel.

I claim as my invention:

1. An elevator system comprising:

an elevator car having top and front portions, with the front portion defining an entranceway, door means for said entranceway, door operator means, mounting means including mounting brackets, bolts, and resilient coupling means for adjustably mounting said door operator means on the top portion of said elevator car, with said mounting means being accessible from the top portion of the elevator car, and means linking said door operator means with said door means to impart linear motion thereto, said mounting brackets having slots therein which cooperate with said bolts to mount said mounting brackets on the top portion of said elevator car, with the slots being oriented to permit horizontal adjustment of the mounting brackets relative to the elevator car in a first predetermined direction, said resilient coupling means being secured between said mounting brackets and said door operator means, with said door operator means having slots which cooperate with said resilient coupling means to permit horizontal adjustment of the door operator means relative to the elevator car in a second predetermined direction, perpendicular to said first predetermined direction.

2. The elevator system of claim 1 wherein the resilient coupling means includes a plurality of resilient coupling members, with certain of the resilient coupling member having vertically oriented stud members, and the mounting brackets include tapped openings, with the vertically oriented stud members extending into the tapped openings to permit predetermined vertical adjustment of the door operator means.

3. The elevator system of claim 1 wherein the resilient coupling means includes a plurality of resilient coupling members, with certain of the resilient coupling members including horizontally oriented stud members, and wherein the mounting brackets have slots therein which cooperate with said horizontally oriented stud members to permit predetermined vertical adjustment of the door operator means.

4. The elevator system of claim 1 wherein the resilient coupling means includes a plurality of resilient coupling members having stud members, with certain of the resilient coupling members being oriented such that the longitudinal axes of their stud members are vertically oriented, and with certain other resilient coupling members being oriented such that the longitudinal axes of their stud members are horizontally oriented, and wherein the mounting brackets include tapped openings which cooperate with the stud members having the vertically oriented longitudinal axes, and slots which cooperate with the stud members having the horizontally oriented longitudinal axes, to permit vertical adjustment of the door operator means.

5. The elevator system of claim 1 wherein the door operator means includes an enclosure having bottom and back portions, with said bottom and back portions defining the slots which permit horizontal adjustment of the door operator means in the second predetermined horizontal direction.

6. The elevator system of claim 5 wherein the resilient coupling means includes a plurality of resilient coupling members, at least certain of the mounting brackets include an elongated channel member having first and second ends, a bight portion, first and second leg portions, and first and second flange portions, with said first and second flange portions being disposed against the top portion of the elevator car, and at least certain of the mounting brackets include an upstanding plate member at the second end, with certain of the resilient coupling members being disposed between the bight portions of the mounting brackets and the bottom portion of the door operator means, and with other of the resilient coupling members being disposed between the upstanding plate members and the back portion of the door operator means.

7. The elevator system of claim 6 wherein the first and second flange portions define the slots which permit horizontal adjustment of the mounting brackets in the first predetermined horizontal direction.

8. The elevator system of claim 6 wherein the upstanding plate members define the slots which cooperate with certain of the resilient coupling members to permit predetermined vertical adjustment of the door operator means.

9. The elevator system of claim 6 wherein the bight portions define the tapped openings which cooperate with certain of the resilient coupling members to permit predetermined vertical adjustment of the door operator means.

10. The elevator system of claim 1 wherein the resilient coupling means includes a plurality of resilient coupling members, and the mounting brackets define additional slots and tapped openings, with certain of the resilient coupling members extending between cross-oriented slots in the door operator means and mounting bracket, and with other resilient coupling members extending between slots and tapped openings in the door operator means and mounting brackets, respectively, to permit both horizontal and vertical adjustment of the door operator means.

11. The elevator system of claim 1 wherein the door means includes at least first and second door panels, and the door operator means includes a front portion, said front portion of the door operator means including first and second hanger roller tracks which overhang the front portion of the elevator car, said first and second hanger roller tracks being disposed in horizontally spaced relation, with the space between them being accessible from above and from below, first and second hanger plates each having hanger rollers mounted thereon, said first and second hanger plates being disposed between said spaced first and second hanger roller tracks, with their associated hanger rollers engaging the first and second hanger roller tracks, respectively, and means fastening said first and second door panels to said first and second hanger plates, respectively.

12. The elevator system of claim 11 wherein the spacing between the first and second hanger roller tracks is selected to enable the first and second hanger plates and associated first and second door panels, respectively, to be lifted vertically from their mounted positions through this space.

13. The elevator system of claim 11 wherein the door operator means drives the first and second door panels at different speeds.

14. The elevator system of claim 13 wherein the hanger roller track associated with the slower of the first and second door panels is closer to the front portion of the elevator car than the hanger roller track associated with the faster of the first and second door panels.

* * * * *